US007888635B2

(12) United States Patent
Belov et al.

(10) Patent No.: US 7,888,635 B2
(45) Date of Patent: Feb. 15, 2011

(54) ION FUNNEL ION TRAP AND PROCESS

(75) Inventors: Mikhail E. Belov, Richland, WA (US); Yehia M. Ibrahim, Richland, WA (US); Biran H. Clowers, West Richland, WA (US); David C. Prior, Hermiston, OR (US); Richard D. Smith, Richland, WA (US)

(73) Assignee: Battelle Memorial Institute, Richland, WA (US)

( * ) Notice: Subject to any disclaimer, the term of this patent is extended or adjusted under 35 U.S.C. 154(b) by 410 days.

(21) Appl. No.: 12/156,360

(22) Filed: May 30, 2008

(65) Prior Publication Data

US 2009/0294662 A1 Dec. 3, 2009

(51) Int. Cl.
*H01J 49/26* (2006.01)

(52) U.S. Cl. ..... 250/283; 250/281; 250/282

(58) Field of Classification Search ..... 250/281, 250/282, 290, 291, 292, 293, 283, 288, 294, 250/295, 296
See application file for complete search history.

(56) References Cited

U.S. PATENT DOCUMENTS

| | | | | |
|---|---|---|---|---|
| 5,206,506 | A * | 4/1993 | Kirchner | 250/281 |
| 2004/0094702 | A1* | 5/2004 | Clemmer | 250/283 |
| 2005/0092911 | A1* | 5/2005 | Hoyes | 250/282 |
| 2005/0258364 | A1* | 11/2005 | Whitehouse et al. | 250/292 |
| 2006/0226353 | A1* | 10/2006 | Tang et al. | 250/287 |
| 2008/0302958 | A1* | 12/2008 | Green | 250/282 |
| 2009/0134321 | A1* | 5/2009 | Hoyes | 250/282 |
| 2010/0065737 | A1* | 3/2010 | Bateman et al. | 250/283 |
| 2010/0237237 | A1* | 9/2010 | Green et al. | 250/283 |

OTHER PUBLICATIONS

Wyttenbach et al., Design of a new electrospray ion mobility mass spectrometer, International Journal of Mass Spectrometry, vol. 212, (2001), pp. 13-23.
Creaser et al., A Tandem Ion Trap/Ion Mobility Spectrometer, Anal. Chem, vol. 72, (2000), p. 2724-2729.
Eiceman et al., Review of Scientific Instruments, vol. 72, No. 9, Sep. 2001, pp. 3610-3621.
Hoaglund et al., An Ion Trap Interface for ESI-Ion Mobility Experiments, Anal. Chem, vol. 69, (1997), pp. 4156-4161.
Ibrahim et al., Ion-Funnel Trap Interface for Orthogonal Time-of-Flight Mass Spectrometry, Anal. Chem, vol. 79, (2009), pp. 7845-7852.

(Continued)

*Primary Examiner*—Robert Kim
*Assistant Examiner*—Nicole Ippolito Rausch
(74) *Attorney, Agent, or Firm*—James D. Matheson

(57) ABSTRACT

An ion funnel trap is described that includes a inlet portion, a trapping portion, and a outlet portion that couples, in normal operation, with an ion funnel. The ion trap operates efficiently at a pressure of ~1 Torr and provides for: 1) removal of low mass-to-charge (m/z) ion species, 2) ion accumulation efficiency of up to 80%, 3) charge capacity of ~10,000,000 elementary charges, 4) ion ejection time of 40 to 200 μs, and 5) optimized variable ion accumulation times. Ion accumulation with low concentration peptide mixtures has shown an increase in analyte signal-to-noise ratios (SNR) of a factor of 30, and a greater than 10-fold improvement in SNR for multiply charged analytes.

32 Claims, 9 Drawing Sheets

OTHER PUBLICATIONS

Tang et al., High-Sensitivity Ion Mobility Spectrometry/Mass Spectrometry Using Electrodynamic Ion Funnel Interfaces, Anal. Chem., vol. 77, (2005), pp. 3330-3339.

Shaffer et al., A Novel Ion Funnel for Focusing Ions at Elevated Pressure Using Electrospray Ionization Mass Spectrometry, Rapid Communication Mass Spectrometry, 1997, vol. 11, pp. 1813-1817.

* cited by examiner

ION FUNNEL ION TRAP AND PROCESS

This invention was made with Government support under Contract DE-AC05-76RLO1830 awarded by the U.S. Department of Energy. The Government has certain rights in the invention.

FIELD OF THE INVENTION

The present invention relates generally to instrumentation and methods for guiding and focusing ions in the gas phase. More particularly, the invention relates to an ion funnel ion trap and method for transmission of ions between coupled stages, e.g., for separation, for characterization, and/or for analysis of preselected ions at different gas pressures.

SUMMARY OF THE INVENTION

The invention is a system for ion analysis that includes an ion funnel ion trap (IFT) that comprises: an inlet portion defined by electrodes that diverges ions in an ion beam introduced thereto to expand same; a trapping portion defined by electrodes that operatively couple to the inlet portion and traps and accumulates a preselected quantity of ions received from the inlet portion. The trapping portion includes an electrostatic grid that controls entry of ions from the inlet portion and one or more electrostatic grids that control outflow of a preselected quantity of ions accumulated in, or otherwise released from, the trapping portion; and an outlet portion that is defined by electrodes that are operatively coupled to the trapping portion and serve to converge preselected ions released from the trapping portion. Electrodes of the ion trap have an inner geometry that is symmetric in the X plane, the Y plane, and/or the X/Y plane with respect to the Z-axis (axial axis) of the ion trap. The ion trap has an inner electrode geometry cross section selected in the range from about 0.02 mm to about 20 mm. Electrodes of the ion trap are equipped to include an rf-potential that is phase shifted 180 degrees from a subsequent electrode in the ion trap. The inlet portion is defined by a series of axially aligned concentric ring electrodes that collectively define an ion flow path. Each electrode in this series has an inner geometry perimeter that is equal to, or greater than, an electrode preceding it in the series. Length of the inlet portion is not limited and is a function of the diameter of the trapping portion. In an exemplary embodiment, length of the inlet portion is ~5 mm long. The inlet portion includes an electrode that couples the inlet portion to a conductance limit of a preceding ion stage. In a preferred configuration, the inlet portion couples with, or is integrated with, an electrodynamic ion funnel as the preceding ion stage. The trapping portion of the IFT includes a series of axially aligned concentric ring electrodes. Each electrode in the trapping portion has an inner geometry perimeter that is equal to, smaller than, or greater than, an electrode preceding it in the series of electrodes that make up the trapping portion. The trapping portion includes a series of axially aligned concentric ring electrodes. Each electrode in the trapping portion has an inner geometry perimeter that is equal to, smaller than, or greater than, an electrode preceding it in the series. The inner geometry perimeter is preferably selected in the range from about 10 mm to about 30 mm, but is not limited. The trapping portion provides for accumulation of preselected quantities of ions therein. In a preferred embodiment, the trapping portion includes three electrostatic grids, an entrance grid; a trapping grid; and exit grid. The entrance grid controls entry of ions received from the inlet portion into the trapping portion. Trapping grid provides for accumulation of ions for preselected time periods in the trapping portion, e.g., in close proximity to the exit of the trapping portion. The trapping grid further minimizes effects of electric field penetration into the trapping portion. The exit grid prevents ions received in a continuous ion beam into the trapping portion from escaping the trapping portion during the accumulation period, and releases selected ions during an extraction period from the trapping portion at a preselected rate into the outlet portion. Grids are preferably composed, e.g., of a metal mesh (e.g., nickel mesh) with preselected densities, e.g., a density of about 20 lines/inch that define, e.g., adjacent transmission squares or other shapes in the mesh, which densities and shapes are not limited. The trapping grid and the exit grid are positioned a preselected separation distance apart from each other on the exit side of the trapping portion. The separation distance is on the order of the spacing between adjacent squares in the grid mesh. The trapping portion is configured to deliver a trap gradient that is provided by one or more trap gradient controls. The trap gradient controls couple to various dc-electrodes in the IFT and provide preselected dc-potentials to each of these dc-electrodes which deliver the trap gradient in the trapping portion of the IFT. In an exemplary configuration, a trap gradient control is electrically coupled to a dc-electrode positioned adjacent to, and/or following, an electrostatic entrance grid; another dc-electrode is positioned adjacent to, and/or prior to, an electrostatic trapping grid, and/or an electrostatic exit grid. The trap gradient controls provide preselected dc-potentials to the dc-electrodes. The trapping portion can also be equipped with two electrostatic grids, e.g., an entrance grid and an exit grid, or an entrance grid and a trapping grid. The electrostatic grids can be dc-only grids, but are not limited. An rf-potential can also be simultaneously applied to each of the electrodes of the ion trap that is phase shifted 180 degrees from any other subsequent electrode in the ion trap. The outlet portion of the IFT includes a series of axially aligned concentric ring electrodes that define an ion flow path. Electrodes in this series have an inner geometry perimeter that is equal to, or smaller than, an electrode preceding it in the series. The electrodes of the outlet portion converge and focus ions released from the trapping portion into the outlet portion and introduces ions into a subsequent ion stage. The outlet portion can include an ejection gradient control that couples to a dc-electrode positioned adjacent to an electrostatic grid in the trapping portion, e.g., the exit grid. The ejection gradient control provides a preselected potential to the dc-electrode and moves the preselected ions from the trapping portion into the outlet portion. The outlet portion includes a conductance limit that couples the ion trap to a subsequent ion stage and introduces ions released from the trapping portion at a preselected pressure to the ion stage. Ion stages include, but are limited to, e.g., TOF-MS, IMS, or other ion and analysis instruments. The conductance limit has an inner geometry perimeter that is equal to, or smaller than, an inner geometry perimeter of a subsequent ion stage. Electrodes of the outlet portion define a preferred converging angle of about 30 degrees that minimizes ion losses at the conductance limit of the outlet portion. The outlet portion has a length that depends on the inner geometry perimeters of the trapping portion.

The ion trap provides accumulation of ions that enhances sensitivity of selected ions. These ions are delivered to a subsequent ion stage or instrument. The IFT serves as an interface between at least two ion stages, which stages are not limited. Stages include, but are not limited to, e.g., ion mobility spectrometry (IMS) stages, field asymmetric waveform ion mobility spectrometry (FAIMS) stages, longitudinal electric field-driven FAIMS stages, ion mobility spectrometry with alignment of dipole direction (IMS-ADD), higher-order differential ion mobility spectrometry (HODIMS) stages, parallel planar and non-parallel planar stages, and including components thereof. A preferred ion analysis stage is a time-of-flight mass spectrometer (TOF-MS), e.g., an orthogonal acceleration TOF-MS (i.e., oa-TOF-MS). With high analysis speed, high sensitivity, high mass resolving power, and high mass accuracy, oa-TOF-MS represents an attractive platform for proteomics. The ion trap can be coupled to an oa-TOF-MS, e.g., to increase the instrument duty cycle for operation, e.g., with continuous ion sources such as ESI. Here, an electrospray ionization source provides ions to the ion funnel. Other ion sources can be employed that include, but are not limited to, e.g., MALDI, and other ion sources. The ion trap can employ pressures of from about $10^{-3}$ Torr to about 5 Torr. Since trapping efficiency is proportional to the collision gas pressure, increasing pressure can offer greater sensitivity. In a preferred configuration, the ion trap couples to, or is integrated with, an electrodynamic ion funnel which provides efficient transmission of ions to the IFT. The ion trap provides preselected dc-potentials and rf-potentials that are independent of any dc-potentials and rf-potentials delivered by, e.g., a coupled ion funnel. In addition, the ion trap can provide a dc-gradient that is controlled independently from a dc-gradient of the ion funnel. The dc-gradients of the ion trap are not limited. In an exemplary configuration, the dc-gradient of the ion trap is between about 1 V/cm and about 5 V/cm; the dc-gradient of the ion funnel is between about 10 V/cm and about 30 V/cm. In this configuration, the ion trap includes an rf-frequency of about 600 kHz, an amplitude of about 55 $V_{p-p}$, and a pressure of about 1 Torr and 5 Torr, which parameters are not limited. The ion trap operates at a typical pressure in the range from about 1 Torr to about 10 Torr. A coupled ion funnel may be operated in tandem, e.g., at a pressure selected in the range from about 0.1 Torr to about 100 Torr. The ion trap operates at typical temperatures in the range from about 25° C. to about 50° C. Gas flows inside the ion trap collection portion are nominal. The ion trap can have a length in the range from about 0.5 mm to about 50 mm. The ion trap can also have an inner electrode geometry cross section in the range from about 0.02 mm to about 20 mm. Control over dc-field distribution in the ion trap is crucial for fast ion ejection.

The invention is also a method for transmission of ions between at least two operatively coupled instrument stages for ion analysis that includes the steps of: introducing ions in an ion beam from an ion source to an ion trap that includes: an inlet portion that diverges the ions in the ion beam introduced thereto to expand same; a trapping portion that is operatively coupled to the inlet portion that traps ions received from the inlet portion in the ion beam and accumulates the same therein; the trapping portion includes an entrance grid that is coupled at a receiving end thereof that controls entry of the ions from the inlet portion into the trapping portion; the trapping portion includes an exit grid that is coupled to a releasing end thereof that controls outflow of ions therefrom; and an outlet portion that is coupled to the trapping portion that converges ions released from the trapping portion to converge and focus the same; trapping a preselected quantity of the ions in the trapping portion for a preselected time to accumulate same; and selecting at least one of the ions that is accumulated in the trapping portion; and releasing at least one of the ions at a preselected pressure for analysis of same.

DETAILED DESCRIPTION

The present invention is an ion funnel ion trap (IFT) and process. In a preferred configuration, the ion trap is coupled to an electrodynamic ion funnel, which ion funnel is detailed, e.g., by Shaffer et al. in (*Rapid Commun. Mass Spectrom.* 1997, 11, 1813-1817), incorporated herein in its entirety. Coupling the ion trap with an electrodynamic ion funnel provides the ability to accumulate, store, and eject ions, e.g., in conjunction with various ion analysis instruments including, but not limited to, e.g., ion mobility spectrometry (IMS) instruments, time-of-flight mass spectrometry (TOF-MS) instruments, IMS/TOF-MS instruments, and other instruments and configurations. For example, when coupled to an ion mobility spectrometry (IMS) instrument, the IFT elevates charge density of ion packets ejected from the ion funnel trap (IFT) and provides a considerable increase in overall ion utilization efficiency to the IMS instrument. Coupling to an electrodynamic ion funnel trap improves sensitivity of commercial TOF-MS instruments and can potentially be coupled to other TOF-MS instrument systems available commercially. In addition, the ion funnel trap is expected to drastically improve sensitivity of IMS/TOF-MS instruments. While the ion funnel trap is described herein in conjunction with coupling to an orthogonal acceleration time-of-flight (TOF) mass spectrometer (oa-TOF-MS) for analysis of peptides, the invention is not limited thereto. Here the oa-TOF-MS is equipped with analog-to-digital converter detection. The ion trap operates at a pressure of ~1 Torr and is characterized by a fast ion ejection time of <100 μs. Further increases in trap pressure are feasible, provided adequate ion ejection is implemented. Results show improvements in ion packet charge density are accompanied by 10-30-fold gains in signal-to-noise ratio (SNR) with respect to signals obtained using the same instrument operating in the continuous mode. The trap is optimized for operation at higher pressures. While the present disclosure is exemplified by specific embodiments, it should be understood that the invention is not limited thereto, and variations in form and detail may be made without departing from the spirit and scope of the invention. All such modifications as would be envisioned by those of skill in the art are hereby incorporated. The ion trap will now be described with reference to FIG. 1*a* and FIG. 1*b*.

Figure 1A:
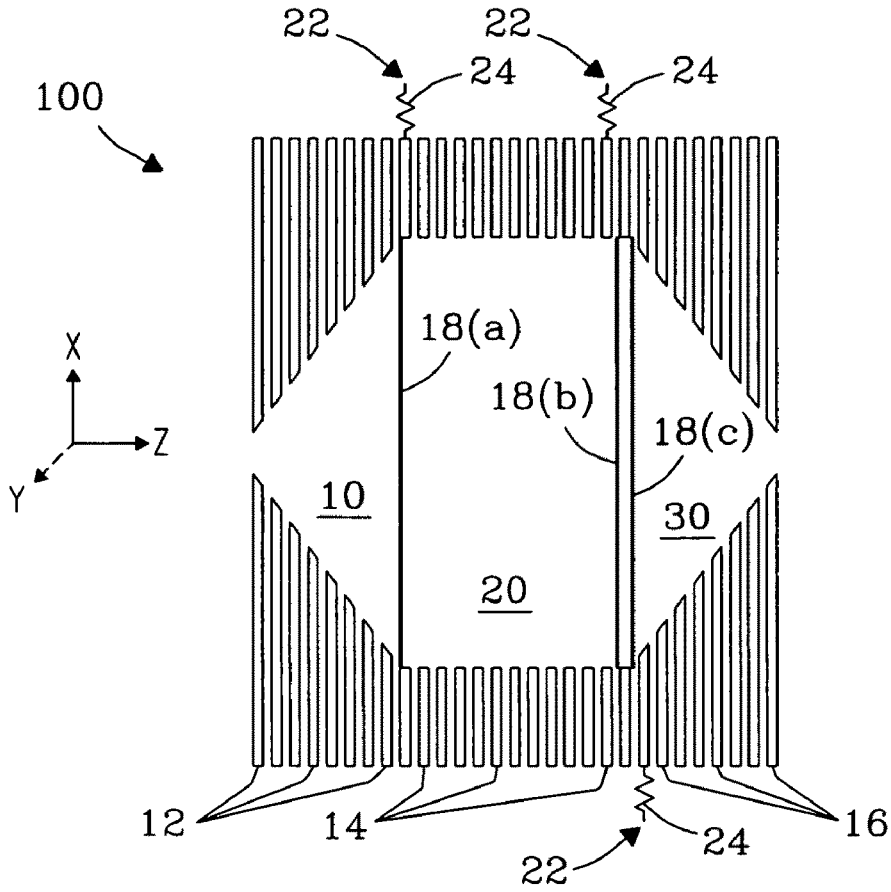
FIG. 1*a* is a schematic of an ion funnel trap (IFT), according to an embodiment of the invention.
Figure 1B:
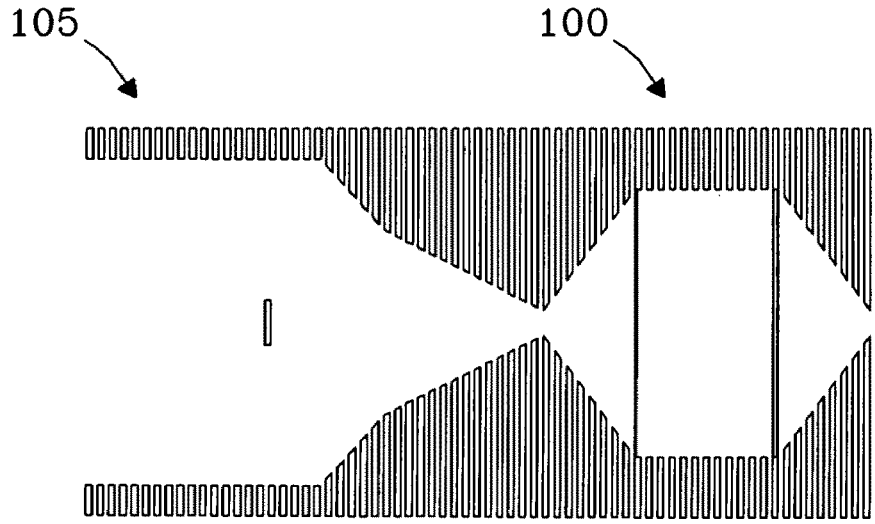
FIG. 1*b* is a schematic of the IFT coupled with an electrodynamic ion funnel, according to a preferred embodiment of the invention.

FIG. 1*a* is a schematic view of an ion funnel trap (IFT) 100, according to a preferred embodiment of the invention. In the figure, IFT 100 includes an inlet portion 10 that has a diverging geometry that maximizes expansion of an ion plume received from a preceding stage; a trapping portion 20 configured to trap and accumulate ions, and an outlet portion 30 that has a converging geometry that focuses ions released from the trapping portion. In the figure, inlet portion 10 includes a number of concentric ring electrodes 12, which number is not limited. Electrodes 12 in the inlet portion expand in diameter [inner diameter, (i.d.)] from, e.g., about 3 mm in a first electrode to 19.1 mm in a last electrode, which dimensions are not limited. The first electrode in inlet portion 10 couples the inlet portion to a preceding stage.

Trapping portion 20 includes a number of concentric ring electrodes 14 of equal diameter, which number is not limited. Electrodes 14 in the trapping portion each with an inner diameter, e.g., of 19.1 mm, which dimensions are not limited. Trapping portion 20 accumulates and traps ions between subsequent ion accumulation and ion release cycles, with the accumulation and release cycles performed in conjunction with ion gating, described further herein. The trapping portion couples with, and releases ions to, outlet portion 30.

Outlet portion 30 includes a number of concentric ring electrodes 16, which number is not limited. Electrodes 16 in the outlet portion decrease progressively in diameter, e.g., from 19.1 mm down to, e.g., 2.4 mm at the conductance limit (or final) electrode of the IFT, which dimensions are not limited. The conductance limit electrode interfaces the IFT to a subsequent ion analysis stage, e.g., an ion mobility drift cell, an rf-multipole interface of a TOF-MS instrument, or other stages, e.g., IMS/IMS-TOF instruments. Refocusing of disperse ion packets released from the trapping portion of the IFT increases sensitivity of ion analysis in the subsequent ion stages.

In the figure, trapping portion 20 is separated from inlet portion 10 and outlet portion 30 by high-transmission electrostatic grids (ion gates) 18 (e.g., 95% transmission, nickel mesh, 20 lines/inch), here shown with an entrance grid 18(*a*), a trapping grid 18(*b*), and an exit grid 18(*c*), but is not limited thereto. Entrance grid 18(*a*) is positioned at the entrance to trapping portion 20. Trapping grid 18(*b*) and exit grid 18(*c*) are positioned on the exit side of the trapping portion. The dual grid configuration at the exit results in faster ion ejection from the IFT, which improves efficiency and allows concentrations of ions directly preceding the trapping grid to be increased.

In the instant embodiment, three (3) dc-gradient controls 22 couple through selected 100 kΩ resistors 24 to preselected ring electrodes 14 within trapping portion 20 and ring electrodes 16 positioned adjacent to the trapping portion within outlet portion 30. Each gradient control 22 provides control of dc gradients in the ion trap. For example, two dc-gradient controls 22 positioned near entrance grid 18(*a*) and trapping grid 18(*b*) of trapping portion 20, respectively, permit adjustment of the dc-gradient within the trapping portion. A third dc-gradient control 22, i.e., an ejection gradient control, generates an electric field that guides ions released from the trapping portion into outlet portion 30. A fourth dc-gradient control (not shown) may be coupled directly to a conductance limit, or last, electrode at the exit of outlet portion 30 to assist flow of ions to a subsequent stage. Release and ejection of ions from the IFT are assisted not only by pulsed potentials applied to the entrance grid and the trapping grid through trap gradient controls 22, but also by dc-potentials applied to resistors that couple to the IFT electrodes, e.g., as a chain of resistors, described further herein. Speed of ion ejection from the IFT drastically improves at pressures greater than or equal to about 1 Torr. Ability to control speed of ion ejection is particularly attractive for interfacing to, e.g., IMS or IMS-TOF-MS instruments. In a preferred configuration, illustrated in FIG. 1*b*, IFT 100 couples with an electrodynamic ion funnel 105 which is used as a preceding ion stage, described further in reference to FIG. 2.

Figure 2:
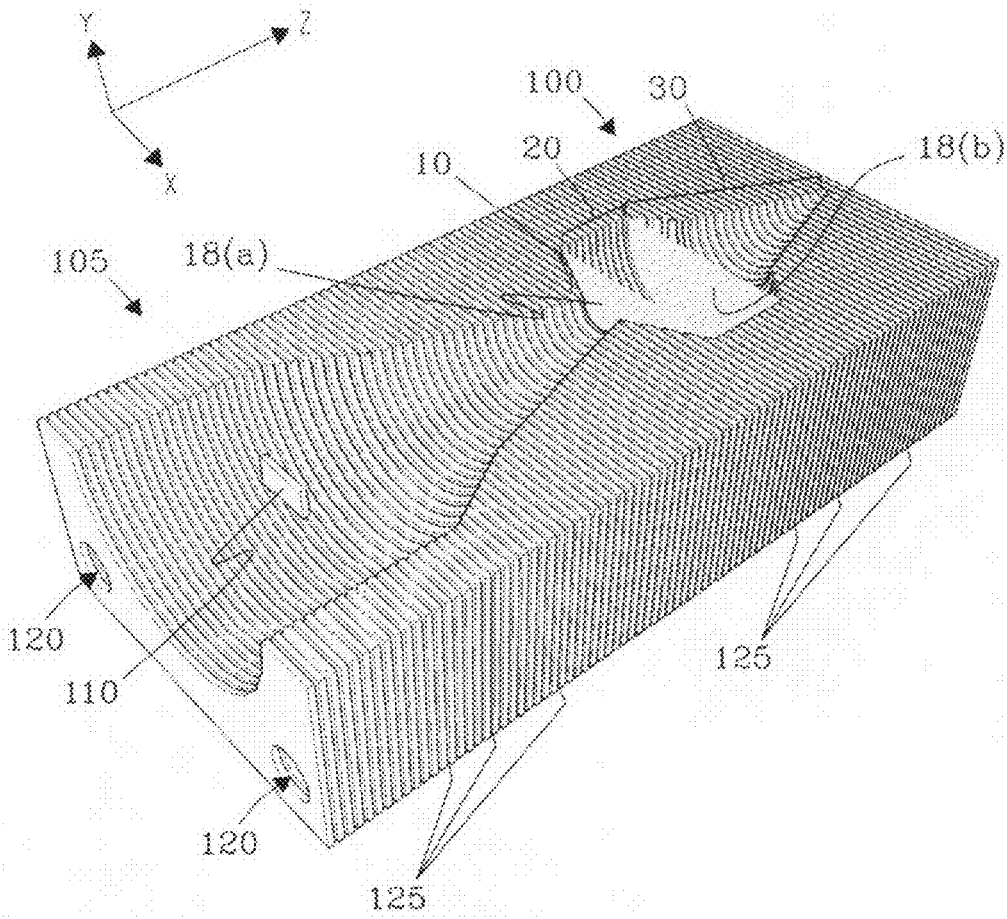
FIG. 2 is a lengthwise cross-sectional view of the ion funnel trap (IFT) coupled with an electrodynamic ion funnel.
Figure 3A:
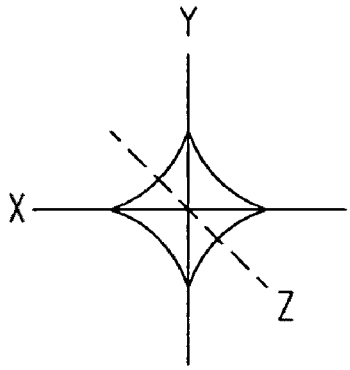
FIGS. 3*a*-3*f* illustrate various inner geometries of electrodes of the ion trap.
Figure 3B:
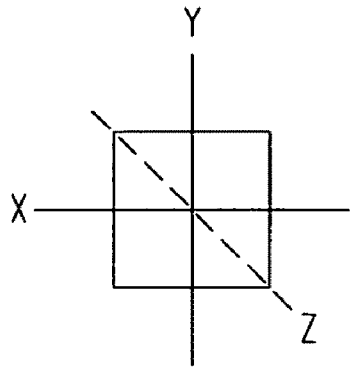
Figure 3C:
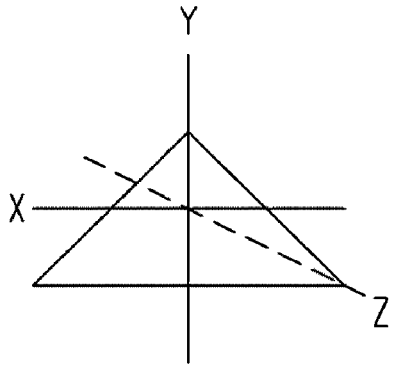
Figure 3D:
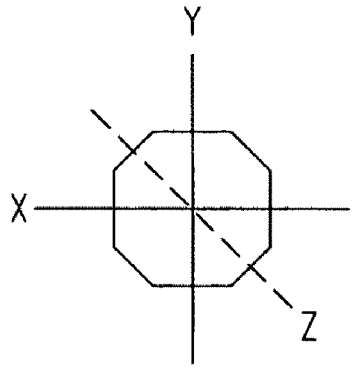
Figure 3E:
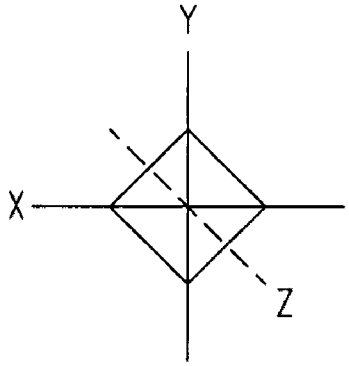
Figure 3F:
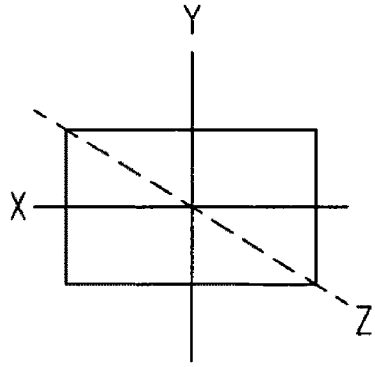

FIG. 2 is a lengthwise cross-sectional view showing the bottom half of ion funnel trap (IFT) 100. In the figure, the IFT is coupled with an electrodynamic ion funnel 105 which is used as a preceding ion stage. In the instant configuration, electrodes of the ion funnel and of the IFT are assembled onto four ceramic rods (not shown) through entry holes 120 (two are shown) that ensure proper axial alignment of both the ion funnel and IFT. In an exemplary embodiment, each electrode of the IFT is 0.5 mm thick and is separated from subsequent or preceding electrodes by a 0.5 mm spacer 125 composed of polytetrafluoroethylene, also known as TEFLON®. Spacers positioned between each funnel electrode and trap electrode ensure that the funnel pressure matches ambient gas in the ion funnel trap. Ions received from the ion funnel are introduced to inlet portion 10 and delivered to trapping portion 20 and accumulated. Entrance grid 18(*a*) and trapping grid 18(*b*) provide trapping of ions within the trapping portion. Ions accumulated in the trapping portion are subsequently released to outlet portion 30 through exit grid (not shown), and focused and delivered to a subsequent ion stage as described previously herein.

FIGS. 3*a*-3*f* illustrate various exemplary inner geometries of electrodes of the ion trap, which geometries are not intended to be limiting. All geometries as will be considered or implemented by those of skill in the art in view of the disclosure are within the scope of the invention. In the figure, each of the inner geometries is symmetric in either the X plane, the Y plane, and/or the X/Y plane with respect to the Z-axis. Here, the Z-axis refers to the axial dimension of the ion trap. As will be understood by those of skill in the art, electrodes geometry of electrodes can be rotated with respect to the Z-axis dimension. The term "symmetric" as used herein means a configuration that is equivalent on opposite sides of a dividing line, a plane, or about a center axis. The term symmetric also encompasses any rotation of an inner electrode geometry that becomes symmetric in the process of rotation. The cross section of a preselected inner electrode geometry is defined as the area of the largest circle that can be inscribed within that electrode geometry.

Figure 4:
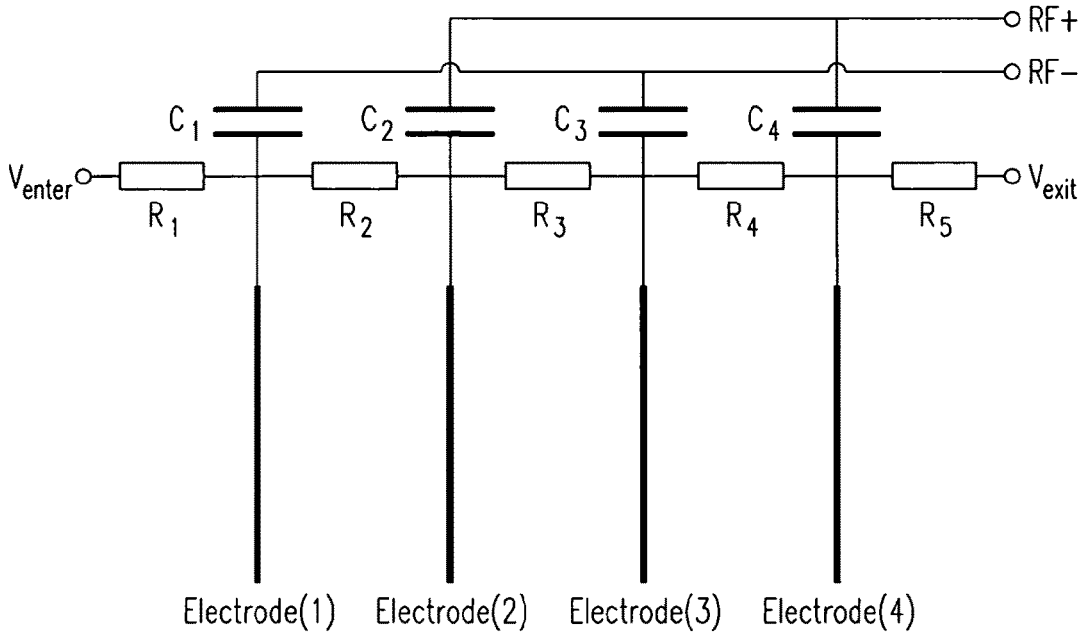
FIG. 4 is a schematic that shows components for delivering waveforms used in conjunction with the ion funnel trap.

FIG. 4 is a schematic showing selected components in a preselected configuration that deliver dc-gradients and preselected waveforms to the ion funnel trap (IFT), which components are not limited. In the figure, a chain (series) of coupled resistors (e.g., $R_1$-$R_5$) spans the length of the IFT. Each electrode of the IFT is coupled to a separate resistor. To generate a voltage gradient across the resistor chain, two voltages, e.g., an entrance voltage ($V_{enter}$) and an exit voltage ($V_{exit}$) are applied at the entrance and exit points of the resistive divider.

Entrance voltages ($V_{enter}$) and exit voltages ($V_{exit}$) applied to the resistor chain establish a preselected dc-gradient field used to drive ions through the IFT. By adjusting the difference between the entrance and exit voltages, the gradient that defines the electric field can be varied. The resistor chain couples to a power supply (not shown), e.g., a nine-channel power supply. Use of dc-gradient controls (FIG. 1*a*) permit adjustment and control of the dc-gradient within the trapping portion. In operation, a dc-gradient of, e.g., 4 V/cm in the IFT, can be controlled independently of a dc-gradient of, e.g., 20 V/cm, used in an electrodynamic ion funnel that may be coupled thereto. The electric field provided by a dc power supply to the IFT is preferably about 25 V/cm, except for the ion trapping portion, which is preferably held at ~1 V/cm. The IFT operates at a typical pressure of ~1 Torr and is characterized by a fast ion ejection time of <100 μs.

Ions are confined radially in the trapping portion of the IFT using preselected rf-fields. The rf-fields are established with capacitors (e.g., $C_1$-$C_4$) which are electrically coupled, e.g., as capacitor networks, to preselected electrodes. Effective potential used to trap ions in the trapping portion is generated by applying rf-potentials 180° out of phase with a pair of independent capacitor networks, one connected to even-numbered electrodes and another connected to odd-numbered electrodes. Each capacitor network links to a preselected rf-voltage source. Preferably, an rf-field generator is used to generate an rf-field at preselected rf-frequencies and amplitudes, which are not limited. For example, an rf-frequency of, e.g., 520 kHz and amplitude of 125 $V_{p-p}$ can be used. In the trapping portion, an rf-frequency of, e.g., 600 kHz and amplitude of 55 $V_{p-p}$ can be used. In another application, the 180° phase-shifted rf-fields are applied to adjacent ring electrodes at a peak-to-peak amplitude of, e.g., 70 $V_{p-p}$ and a frequency of 600 kHz, which parameters again are not limited. Ions released from the trapping portion are directed toward a subsequent or adjacent stage (e.g., an IMS drift cell) using a preselected dc-gradient. Ion transmission through the IFT can be improved by superimposing a dc-field onto the rf-field applied to each electrode.

The IFT can operate in a continuous mode or a trapping mode of operation. The term "trapping mode" refers to the set of conditions by which ions are accumulated within the trapping portion of the IFT and is followed by release of ions to a subsequent ion analysis stage, e.g., IMS analysis stage. The term "continuous mode" refers to the set of conditions by which ions are transmitted with their associated ion current through the IFT without any interference from the electrostatic grids (i.e., entrance, trapping, and exit grids) within the trapping portion. The continuous mode is achieved by setting potential of the dc-only grids to values that equal those of the uniform dc-gradient in the coupled ion funnel. While operation of the IFT and ion funnel has been described in reference to preferred operating parameters, parameters are not limited thereto. All electrical configurations and parameters and stages as will be coupled to the IFT by those of skill in the art are within the scope of the invention.

Figure 5:
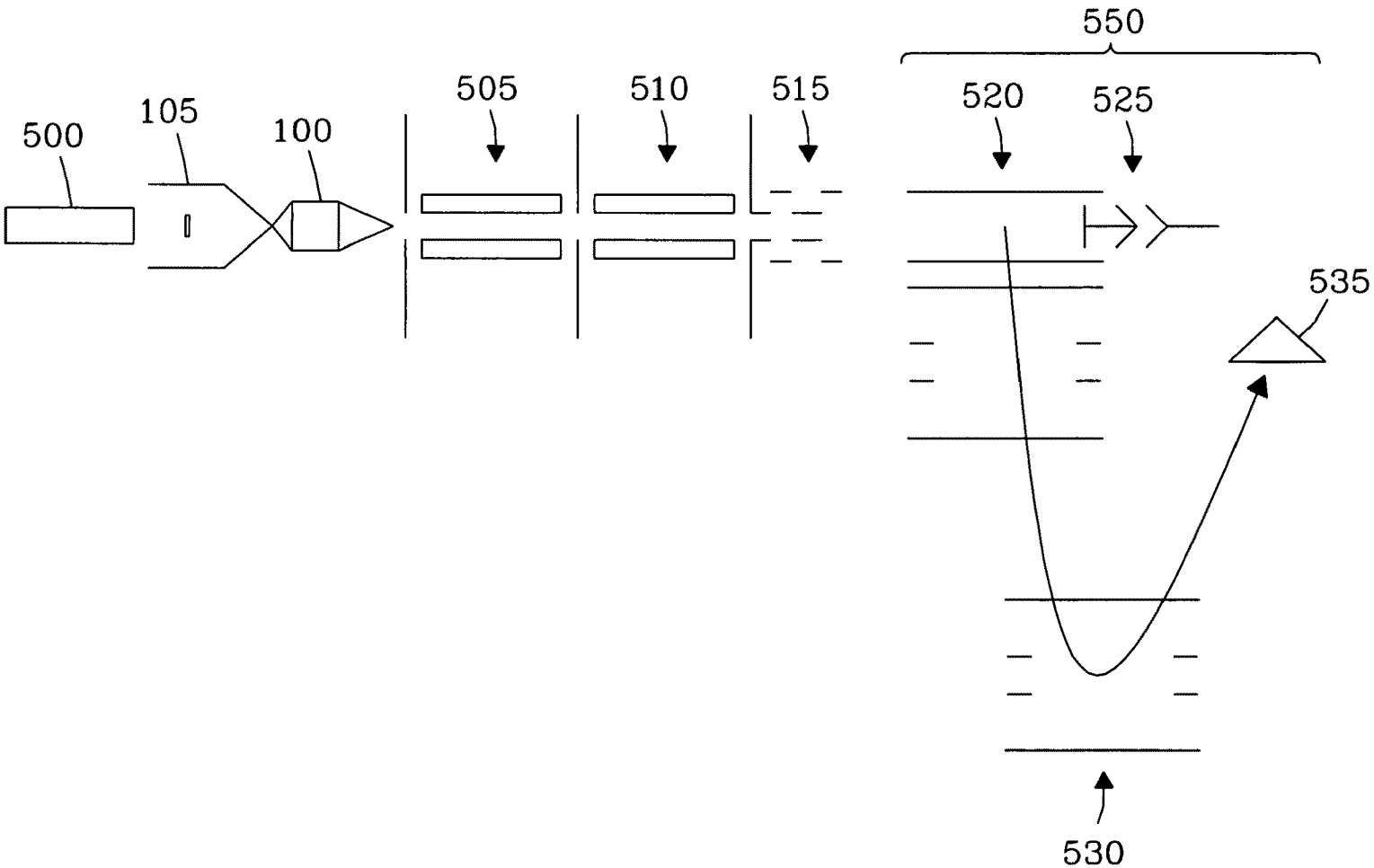
FIG. 5 illustrates an exemplary instrument system that employs the ion funnel trap of the invention.

FIG. 5 illustrates an exemplary instrument system and configuration that employs the ion funnel ion trap (IFT) 100 described previously herein. Here, a heated capillary 500 introduces ions to the ion trap through an electrodynamic ion funnel 105 coupled thereto. The IFT couples to an orthogonal acceleration (oa)-time-of-flight (TOF) mass spectrometer 550 (oa-TOF). Here the IFT interfaces to the oa-TOF through a collision quadrupole 505, a selection quadrupole 510, and various Einzel lenses 515 (that provide ion focusing prior to introduction of ions to the oa-TOF). The oa-TOF instrument 550 includes an ion pusher component 520, a charge collector 525, a reflectron component 530, and a detector 535. Coupled components are not limited. The ion trap can be coupled through use of terminal or conductance limit electrodes that enable control over the axial dc-gradient in the IFT. The instant instrument configuration has been characterized in both a trapping and a continuous mode. Performance of the oa-TOF in trapping mode exhibited an order of magnitude improvement in signal-to-noise (S/N) compared to that observed in the continuous mode (i.e., a continuous beam regime). In particular, intensities of analyte ions in the trapping mode exceeded those in the continuous mode by an order of magnitude. Improvement in (S/N) was due to an increase in sensitivity and reduction in the level of background noise. Background noise reduction is due to more efficient desolvation of ions during trapping. Capability of data-directed removal of low m/z chemical noise species prior to ion accumulation in the trap is important for increasing the linear dynamic range of any instrument configuration, which is enabled by segmenting the rf-field applied to the ion funnel.

Figure 6:
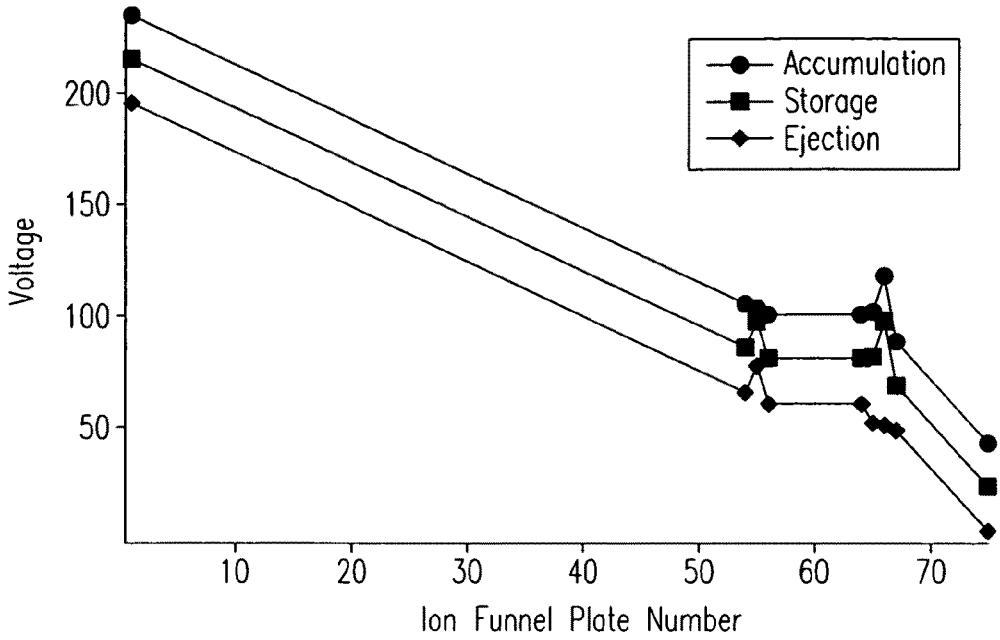
FIG. 6 presents a voltage profile for operation of the ion funnel trap.

FIG. 6 shows exemplary voltage profiles used to accumulate, store, and eject ions in the IFT for a given ion gating cycle. An IFT ion gating cycle typically consists of three distinct events: 1) injection and accumulation of ions, 2) ion storage, and 3) ion ejection. In a preferred configuration, the IFT is coupled with an electrodynamic ion funnel described previously (FIG. 1*b*). In the figure, voltage is plotted as a function of electrode number in the preferred instrument configuration. Exemplary voltage profiles are shown for a single ion gating cycle, described further in reference to FIG. 7 below. Ions are accumulated within the IFT by raising and lowering potentials on each of the entrance grid, trapping grid, and ejection grid surrounding the trapping portion in accordance with exemplary voltage profiles shown in the figure. In the illustrated gating cycle, ions are injected into the ion trapping portion by lowering potential of the entrance grid, e.g., from 80 V to 66 V. Ions introduced to the trapping portion are radially confined by an rf-potential (e.g., 61.5 V) applied to the trapping grid and a repelling potential (e.g., 68 V) applied to the exit grid. After a user-defined accumulation period, potential of the entrance grid is restored, e.g., to 80 V, and storage of ions begins in a storage phase. During both the accumulation and storage events, the exit grid is held to a potential of, e.g., 68 V. To eject ions, trapping and exit grids can be simultaneously ramped to 51 V and 49 V, respectively.

Figure 7:
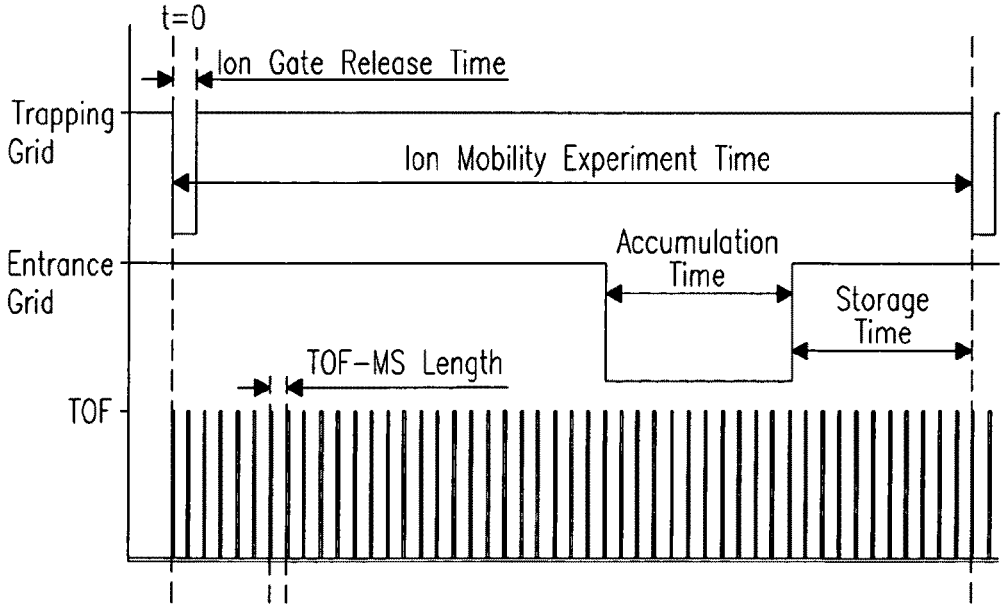
FIG. 7 presents a timing sequence for operation of the ion funnel trap.

FIG. 7 presents an exemplary timing sequence for operation of the ion funnel trap that includes a gate cycle that provides for accumulation, storage, and ejection of ions in the ion funnel trap. The timing sequence is shown for an instrument configuration that includes the ion funnel trap coupled to an electrodynamic ion funnel (preceding stage) and a dual-stage reflectron oa-time-of-flight mass spectrometer (subsequent stage). The instrument configuration is not limited. In an alternate configuration, an ion-mobility-quadrupole-time-of-flight mass spectrometer (IMS TOF-MS) as a (subsequent stage) was used. The TOF-MS is detailed, e.g., by Clowers et al. (Analytical Chemistry, 2008, 80, pgs. 612-623) incorporated herein. Here, an electrospray ionization source provides ions through the ion funnel to the IFT. A key aspect of IFT performance is the configuration of the trapping portion. At lower pressure (e.g., 1 Torr), the ion trap can be configured with a single entrance grid and a single exit grid, e.g., as described by Ibrahim et al. (Analytical Chemistry, 2007, 79, 7845-7852). At higher pressure (e.g., 4 Torr), use of an additional trapping grid results in accelerated ion extraction from the trapping portion, e.g., as described by Clowers et al. (Analytical Chemistry, 2008, 80, pgs. 612-623), which reference is incorporated herein in its entirety. Lower and higher pressure configurations are referred to herein as two and three grid arrangements, respectively. Pulsing voltages applied to the entrance grid and the exit grid control ion populations introduced into the trap, as well as to control ion storage and extraction times, respectively. During the accumulation and storage events, electric field gradient within the inlet portion (FIG. 1*a*) is, e.g., ~1 V/cm. This field is a combination of dc-voltage applied to the ion funnel and field penetration of dc-only grids that surround the trapping portion of the IFT. When ejecting ions from the IFT, electric field gradient within the 5 mm immediately preceding the dc-only trapping grid is, e.g., ~19 V/cm. Number of ions accumulated in the ion funnel trap increases proportionally to the accumulation time. The dc-gradient in the trapping portion can be varied independently from the coupled ion funnel by adjusting potentials of the first and last electrodes in the trapping portion. Ions passing through trapping portion are recollimated in the converging geometry of the outlet portion and are then focused into a subsequent stage. FIG. 7 shows that one IMS experiment encompassing ion accumulation, storage, and ejection events occurs on the time scale of multiple (e.g., 600) TOF-MS spectra acquisitions. Here, ion trap events are synchronous with TOF trigger pulses. TOF-MS generates a sequence of trigger pulses whose repetition rate and number determines the trapping and acquisition times, respectively. Transistor-Transistor Logic (TTL) (output) signals from the TOF are fed into three independent high-voltage switches that provide pulsed voltages to the entrance grid, and the trapping and exit grids (e.g., as pulsing grids). To enable ion injection and accumulation events, potentials at the trapping and exit grids (or just the exit grid for a two grid arrangement) are raised to a level that provides efficient ion beam blocking (see FIG. 6). Ion storage is accomplished by increasing the potential at the entrance grid to a level that ensures blocking of the incoming ion beam at the entrance grid, while trapping and exit grid potentials (or exit grid potential for the two grid arrangement) remain unchanged. The ion extraction event is characterized by reduction in the trapping and exit grid potentials (or just the exit grid potential for the two grid arrangement) to a level corresponding to an optimum ion transmission. In an alternate mode, neither grid is pulsed so ions enter and traverse the IFT continuously.

Figure 8:
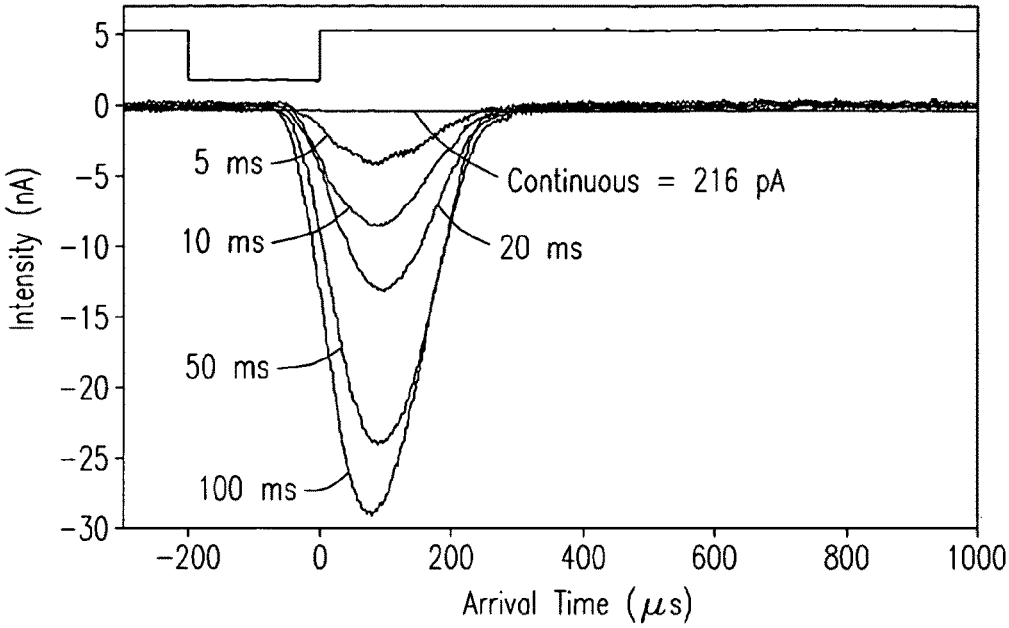
FIG. 8 is a plot showing current pulse measurements for a solution comprising 1 μM Reserpine analyzed in conjunction with the ion funnel trap, according to an embodiment of the method of the invention.

FIG. 8 is a plot showing ion current measured at the collisional quadrupole rods obtained from ESI of a 1 μM Reserpine solution. Ion current pulses were acquired at different accumulation times in the ion trap. The current pulses generated by ions accumulated in the trap are two orders of magnitude higher than the total ion current of the continuous beam. Maximum amplitude of the ion current pulse (28 nA at 100 ms accumulation time) exceeded that of the continuous beam (216 pA) by more than 2 orders of magnitude. Area under each current pulse corresponds to the number of charges released.

Figure 9:
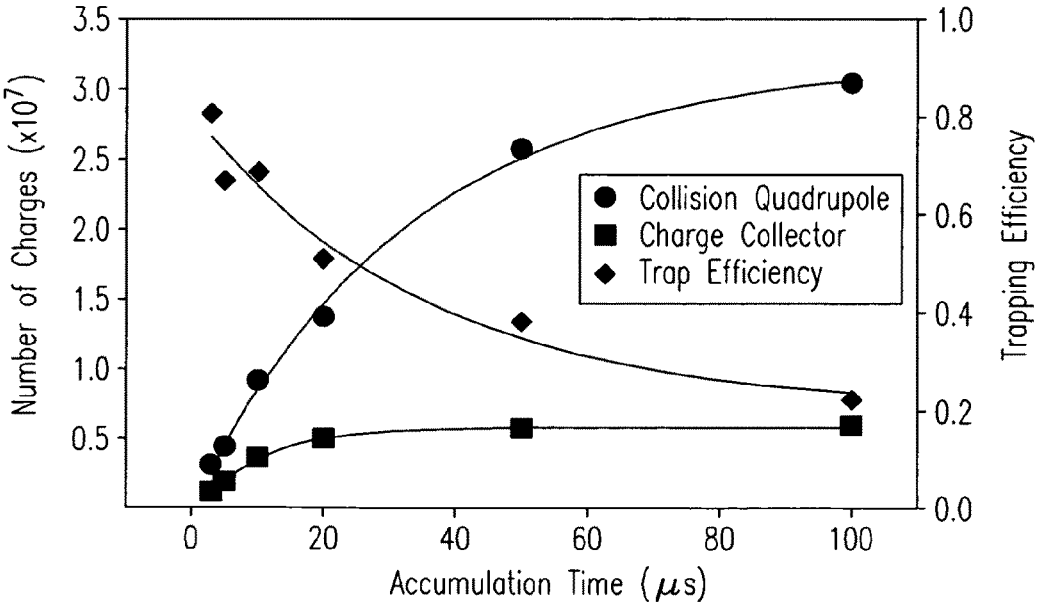
FIG. 9 is a plot showing the trap capacity and efficiency of the ion trap.

FIG. 9 is a plot showing the trap capacity and efficiency of the ion trap. Charges released from the ion trap are calculated from areas under traces in FIG. 8. As shown in the figure, at present, the ion trap has a charge capacity of ~$3\times10^7$ charges. Number of charges increases as the accumulation time increases. While the total number of charges reaches ~$3\times10^7$, the linear range for the ion trap extends to only ~$1\times10^7$ charges. Trapping efficiency is the ratio of the number of ions released from the trap (measured, e.g., at a collisional quadrupole) after a single accumulation event to the number of ions introduced into the trap over the same accumulation period. Number of ions introduced into the ion trap is calculated as a product of the continuous ion current and accumulation time. As shown in the figure, trap efficiency reaches 80% at shorter accumulation times (<10 ms) and decreases to from 20% to 30% (~25%) as the IFT reaches its charge capacity (for accumulation times >50 ms). Data indicate that lower dc-gradients give rise to more efficient ion accumulation while higher dc-gradients result in lower trapping efficiency. The drastic decrease in ion accumulation efficiency with an increase in the ion trap dc-field is related to axial compression of the ion cloud and associated space charge effects. Because of the cylindrical geometry of the trap, the dc-trapping field has a radial component that tends to eject ions in the radial direction where they experience higher rf-oscillations and are lost to the electrodes. When the axial electric field is sufficiently low (4 V/cm), the accumulated ion cloud extends axially, thus increasing the trap capacity and its efficiency. Transmission efficiency is determined as the ratio of the pulsed ion current (expressed as number of charges) at the charge collector to the pulsed ion current at the collisional quadrupole rods as a function of the number of charges exiting the ion trap. Pulsed ion current transmission decreases as the total number of ions transmitted through the collisional quadrupole increase. Improvements in the transmission of dense ion packets through the quadrupole interface are feasible with more efficient ion focusing at higher residual gas pressures. In proteomic experiments, rigorous control over ion populations accumulated in the ion trap can be accomplished using automated gain control. Automated gain control capability is achieved by alternating operation of the ion funnel between continuous and trapping modes.

Figure 10:
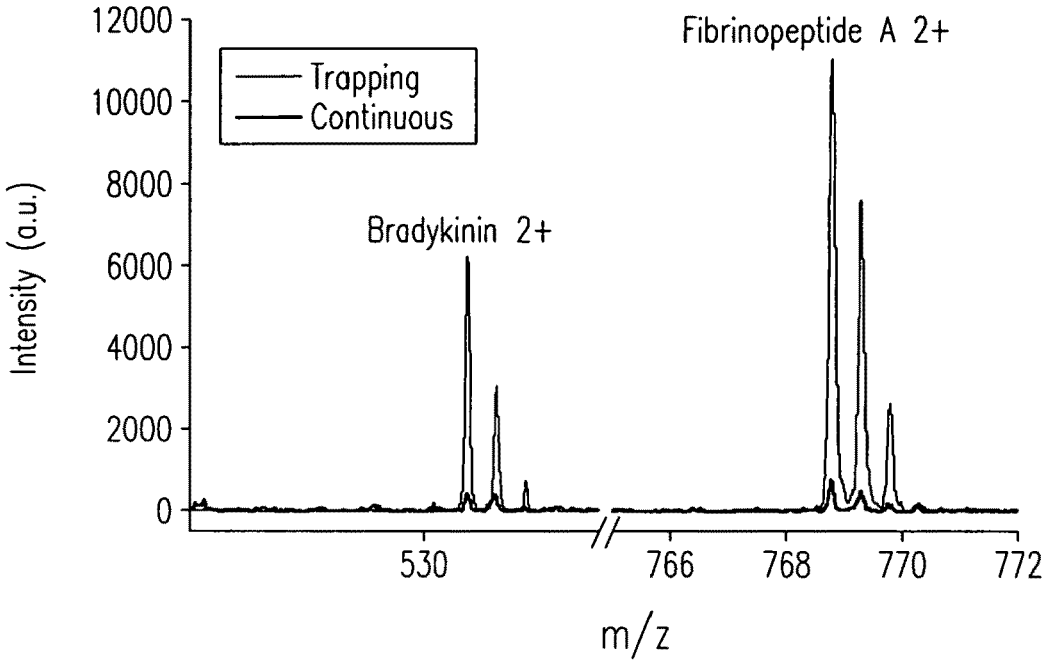
FIG. 10 is a mass spectrum of a simple peptide mixture processed in trapping and continuous modes in a TOF-MS, according to an embodiment of the method of the invention.

FIG. 10 is a mass spectrum for a 10 nM mixture of bradykinin (SEQ. ID. NO: 1) and fibrinopeptide-A (SEQ. ID. NO: 2) processed in trapping and continuous modes in a TOF-MS configuration that includes an IFT, according to an embodiment of the method of the invention. Mixture was prepared with 10 nM for each peptide in the mixture. Aliquots of the sample mixture were analyzed in the TOF mass spectrometer in both Trapping and Continuous modes. For the same TOF acquisition time of 1 s, the intensities of doubly charged bradykinin (SEQ. ID. NO: 1) and fibrinopeptide-A (SEQ. ID NO: 2) ions in the trapping mode are more than an order of magnitude greater than those in the continuous (no trapping) mode. In the trapping mode, the mass spectrum corresponds to 20 trap releases per 1 s (or a sum of 200 TOF pulses), while in the continuous mode, the mass spectrum is obtained as a sum of 9000 TOF pulses.

Figure 11A:
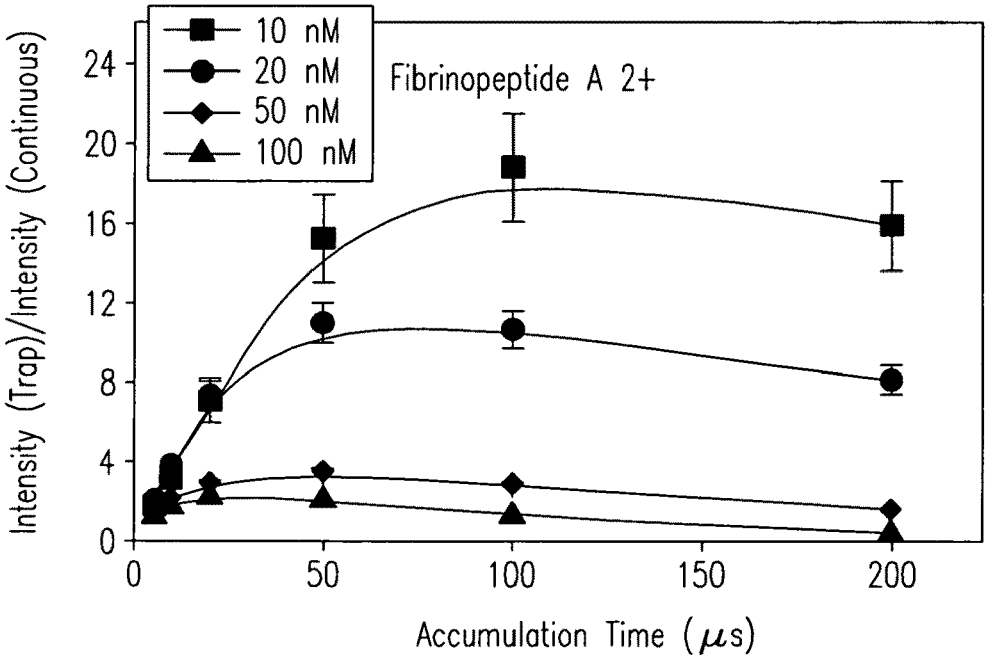
FIGS. 11*a*-11*b* are plots showing signal intensities for two exemplary peptides as a function of accumulation time processed in trapping and continuous modes at different analyte concentrations.
Figure 11B:
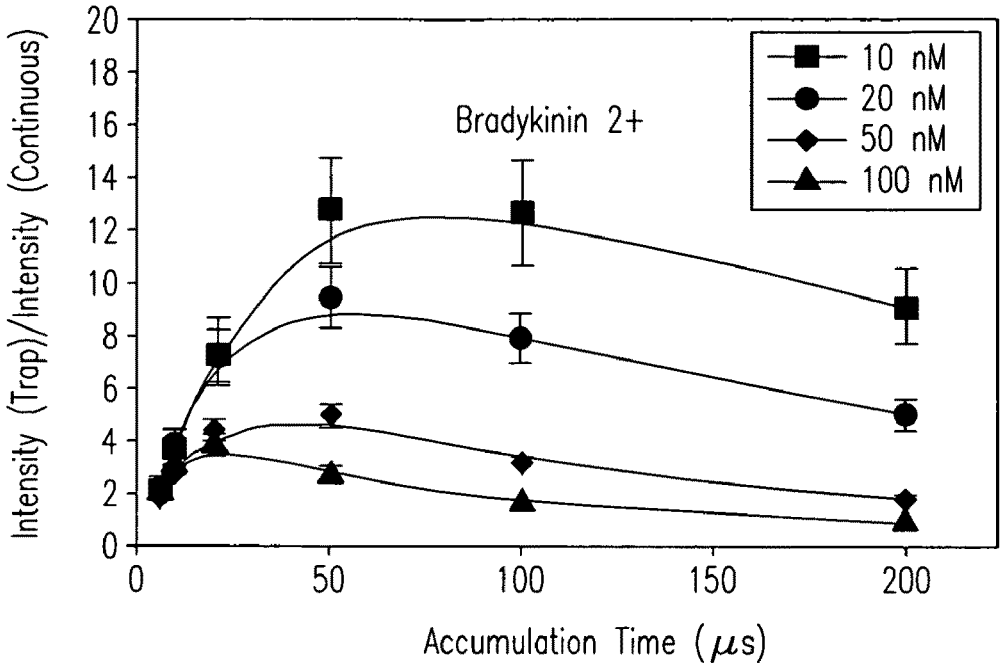

FIGS. 11*a*-11*b* present ratios of intensities of two exemplary peptides, doubly charged bradykinin (SEQ. ID. NO: 1), and fibrinopeptide-A (SEQ. ID. NO: 2) ions in the trapping and continuous modes as a function of accumulation time at different analyte concentrations, respectively. As shown in the figures, at a concentration of 10 nM, a ~13-fold to ~20-fold signal enhancement was observed for bradykinin in the trapping mode as compared to that obtained in the continuous mode; actual S/N gain was ~35 due to a 3-fold lower chemical background. Sensitivity in trapping mode is an order of magnitude greater than in continuous mode at low concentrations. Sensitivity improvement in the trapping mode is also related to a greater and more efficient ion desolvation and a resulting reduction of chemical background. When the ion population reaches trap capacity, no further increase in sensitivity is expected in the trapping mode. As the trap capacity is reached, no further improvement in S/N was observed. An increase in accumulation time results in lower duty cycle (and signal) as fewer ion packets are introduced to the TOF-MS per unit time at longer accumulation times. Decline at longer accumulation times is due to the reduction in the instrument duty cycle. Signal-to-Noise (S/N) values and noise levels acquired for the 10 nM mixture of bradykinin (SEQ. ID. NO: 1) and fibrinopeptide-A (SEQ. ID. NO: 2) are listed in the following TABLE:

| | Bradykinin 2+ | | Fibrinopeptide A 2+ | |
|---|---|---|---|---|
| | S/N | Noise (counts) | S/N | Noise (counts) |
| Continuous | 15.4 | 32.1 | 49.8 | 14.3 |
| Trapping * | 534.9 | 11.8 | 988.8 | 13.5 |
| Ratio (Trapping/ Continuous) | 34.6 | 0.4 | 19.9 | 0.9 |

* Trapping Time = 100 ms
Concentration = 10 nM

Improvement in the S/N of bradykinin (SEQ. ID. NO: 1) is due to an increase in the measured signal intensity and the reduction in noise level. Most background noise is observed in the low m/z range, so chemical noise reduction was not observed for fibrinopeptide-A (m/z 768.8) (SEQ. ID. NO: 2). Enhancements in (S/N) are attributed to a combination of an increase in the number of transmitted ions to the TOF detector due to ion accumulation, to more efficient desolvation of the analyte ions, and to removal of chemical background peaks following the desolvation of smaller ions in the ion trap.

The following examples provide a further understanding of the invention in its broader aspects.

Example 1

IFT Characterization Using Ion Mobility, TOF-MS

Characterization of the IFT was conducted using two modes of detection: (1) IMS-only using a Faraday plate as a charge collector and (2) a commercial TOF instrument interfaced to a custom-built IMS drift cell.

ESI Source. The ESI source consisted of a chemically etched, 20-μm-i.d. emitter [Ref. 30] connected to a transfer capillary (150 μm, Polymicro Technologies, Phoenix, Ariz.) using a zero dead volume stainless steel union (Valco Instrument Co. Inc., Houston, Tex.). Sample solutions were infused using a syringe pump (Harvard Apparatus, Holliston, Mass.) at a flow rate of 300 nL/min. High voltage used to sustain the electrospray ionization (ESI) source was applied through a stainless steel union by a current-limited four-channel power supply (Ultravolt, Ronkonkoma, N.Y.) and held ~2400 V above the heated capillary inlet (150° C.). The electrospray-generated ion plume was sampled using a 64-mm-long transfer capillary with an inner diameter of 0.43 mm. Potential applied to the heated transfer capillary was 210 V higher than the ion mobility drift tube voltage.

Example 2

Ion Mobility-Quadrupole-Time-of-Flight Mass Spectrometer

The current ion mobility system was comprised of four units, each of which contained 21 0.5-mm-thick copper drift rings [80 mm outer diameter (o.d.) X 55 mm inner diameter (i.d.)] separated by ~10-mm spacers comprised of polytetrafluoroethylene, also known as TEFLON®, and connected in series with 1-MΩ high-precision resistors. High voltage for the ion mobility drift cell was supplied by the same four-channel power supply used to drive the ESI source. An 80-mm-long conventional ion funnel located at the terminus of the ion mobility drift cell was used to refocus the disperse ion clouds that exited the IMS drift cell. Inner diameters of the ring electrodes (0.5 mm thick separated by 0.5-mm TEFLON® sheets) decreased linearly from 51 mm to 2.5 mm at the conductance limit, which was held at 35 V. Custom-built power supplies were used to apply rf-voltages and dc-voltages across the brass electrodes in the outlet portion of the IFT. Peak-to-peak rf-voltage was 115 $V_{p-p}$ at a frequency of 500 kHz, and the dc-gradient electric field was adjusted to match the electric field within the IMS drift cell. Pressures (2-4 Torr) inside the IFT and ion mobility drift cell were monitored using a capacitance manometer and regulated using a leak valve that passed dry, high-purity nitrogen into the drift chamber. To maintain a buffer gas flow counter to the direction of ion velocity, the pressure in the drift cell was maintained ~30 mTorr higher than the IFT. For IMS experiments using 4 Torr $N_2$, an electric field of ~16 V/cm was established throughout the IMS drift cell and rear ion funnel. For 2 Torr IMS experiments, the same Townsend number was maintained. Unless stated otherwise, all IMS experiments were conducted at 20±1° C. A shielded Faraday plate was placed immediately following the conductance limit in the outlet portion of the IFT for conducting ion current measurements. Ion signals were amplified using a current amplifier (Keithley Instruments, Inc., Cleveland, Ohio); data were recorded using a oscilloscope (e.g., a TDS-784C oscilloscope, Tektronix, Richardson, Tex.). For experiments employing a TOF mass spectrometer as a detector, a segmented quadrupole consisting of two 11-mm sections following the conductance limit of the rear ion funnel served to optimize ion transmission through a 2.5-mm conductance limit (~15 V). The two sections of the quadrupole were biased to 30 and 22 V, with an rf-potential of 200 $V_{p-p}$ at a frequency of 700 kHz. The chamber between the IMS cell and quadrupole time-of-flight (Q-TOF) mass spectrometer was evacuated using a mechanical pump (Alcatel 2033, Adixen-Alcatel, Hingham, Mass.) to a pressure of ~300 mTorr. Once into the Q0 or collisional quadrupole of the modified commercial Q-TOF (MDS Sciex, Q-Star Pulsar, Concord, Canada), the ions were guided into the pulsing region of the Q-TOF operated at ~7 kHz, which spanned a mass range of 50-2000 m/z. The ion optics of the Q-TOF system were optimized to maximize ion transmission and signal intensity while minimizing the ion transit time to the detector. Data were recorded using a 10-GHz time-to-digital converter interfaced to a custom built software package. Timing sequence of the ion mobility experiment was synchronized with the pulsing frequency of the Q-TOF and controlled using a timing card.

Example 3

Peptide Analysis Using Electrodynamic Ion Funnel, IFT, and oa-TOF-MS

An electrodynamic ion funnel was coupled to the IFT and subsequently to an orthogonal acceleration-time-of-flight (oa-TOF) mass spectrometer in a prototype dual-stage reflectron oa-TOF mass spectrometer configuration (FIG. 5). Low concentration peptide mixtures were analyzed with the IFT in trapping mode. The IFT was coupled through use of added terminal electrodynamic ion funnel electrodes enabling control over the axial dc-gradient in the trapping portion of the IFT. Ions generated in an electrospray source were transmitted through a 508 μm inner diameter (i.d.), 10 cm long stainless steel capillary interface, resistively heated to 165° C., and into the IFT at pressure of ~1 Torr. The 180° phase-shifted rf-fields were applied to adjacent ring-electrodes at a peak-to-peak amplitude of 70 $V_{p-p}$ and a frequency of 600 kHz. Ion transmission through the funnel was improved by superimposing a dc-field onto the rf-field applied to each electrode. In the continuous mode, the dc-gradient applied to the funnel was 20 V/cm. Measurements indicated a maximum charge capacity of ~$3\times10^7$ charges. An order of magnitude increase in sensitivity was observed. A signal increase in the trapping mode was accompanied by reduction in the chemical background. Controlling IFT ejection time resulted in efficient removal of singly charged species and improved the signal-to-noise ratio (S/N) for multiply charged analytes. The ion funnel and IFT combination consisted of 98 brass ring electrodes. Each electrode was 0.5 mm thick and was separated with TEFLON® (polytetrafluoroethylene) spacers 0.5 mm apart. The ion funnel which accepts ions exiting the heated capillary was composed of 24 ring electrodes. Inner diameters (i.d.) of the ring electrodes varied from 25.4 mm at the ion funnel entrance, 19.1 mm in the trapping portion of the IFT, and 2.4 mm at the exit electrode in the outlet portion of the IFT. A jet disrupter in the funnel reduced gas load to subsequent stages of differential pumping while maintaining high ion transmission. Ions exiting the ion funnel were introduced to the inlet portion of the IFT through a 3 mm conductance limit orifice and were accumulated in the trapping portion in trapping mode. The trapping portion comprised, e.g., 10 ring electrodes, each having an internal diameter (i.d.) of, e.g., 19.1 mm. The trapping portion of the IFT was separated from the inlet portion on the ion receiving side and the outlet portion on the ion exit side of the trapping portion by two electrostatic grids fabricated from commercially available 95%-transmission nickel mesh (InterNet Inc., Minneapolis, Minn.). Pulsing voltages applied to the electrostatic grids were used to control ion populations introduced into the IFT, as well as to control ion storage and extraction times, respectively. A dc-gradient in the trapping portion of the IFT was varied independently from the dc-gradient in the ion funnel by adjusting potentials at a first dc-electrode ("Trap in") and a last dc-electrode ("Trap out") in the trapping portion, described previously herein. In continuous mode, potentials on the electrostatic grids were optimized to ensure efficient ion transmission through the trapping region. Ions passing through the trapping portion were recollimated in the outlet (converging) portion and then focused into a 15 cm long collisional quadrupole operating at a pressure of ~$6\times10^{-3}$ Torr. After collisional relaxation and focusing, ions were transmitted through a 20 cm long selection quadrupole at a pressure of $1.5\times10^{-5}$ Torr and focused by an Einzel lens assembly into a TOF extraction region. Collisional and selection quadrupoles were operated at an rf-amplitude of 2500 $V_{p-p}$ and an rf-frequency of 2 MHz. The TOF chamber included a stack of acceleration electrodes, a dual-stage ion mirror, and a 40 mm diameter extended dynamic range bipolar detector, having a 10 μm pore size and 12°±1 bias angle (Burle ElectroOptics, Sturbridge, Mass.). Length of the TOF flight tube was 100 cm, and the distance between the center of the 40 mm long TOF extraction region and the detector axis was 75 mm. Typical full width at half-maximum (fwhm) of signal peaks were 3.0-3.5 ns, yielding an optimum resolving power of 10,000 and a routine resolving power of from 7,000-8,000. The TOF detector was impedance matched to a 2 GS/s 8-bit analog-to-digital converter that enabled routine mass measurement accuracy of ~5 ppm. Continuous and pulsed ion currents in the TOF acceleration stack were measured using a Faraday cup charge collector positioned on the interface axis immediately downstream of the TOF extraction region. Ion current pulses were acquired using a fast current inverting amplifier coupled to a digital oscilloscope. Pulse sequencing for ion trapping was used. With one of the TOF MS control bits (Run/Stop) toggled high at the beginning of each spectrum acquisition, a waveform generator (Hewlett-Packard, Palo Alto, Calif.) was triggered to release a burst of trigger pulses. Repetition rate and number of burst pulses determined the trapping and acquisition times, respectively. Each trigger pulse activated a delay generator (Stanford Research Systems, San Jose, Calif.) which in turn determined pulse widths and time delays in the electrostatic pulsing grids (e.g., an entrance grid and an exit grid). Output TTL signals from the delay generator were fed into two independent high-voltage switches (Behlke, Kronberg, Germany) that provided pulsed voltages for the two electrostatic pulsing grids. In continuous mode, the entrance grid was not pulsed and ESI-generated ions entered the trap continuously. Peptide samples were purchased (Sigma-Aldrich, St. Louis, Mo.), prepared in 50% aqueous methanol acidified with 1% acetic acid and used without further purification. Samples were infused into the mass spectrometer at a flow rate of 0.4 μL/min. The ion funnel and IFT were initially optimized by adjusting rf-fields and dc-fields in the trapping portion of the IFT for higher sensitivity. An optimum rf-amplitude was found for the trapping mode, although no significant signal variation was observed over a wide range of rf-amplitudes in continuous mode. 55 $V_{p-p}$ was used as the optimal rf-amplitude, but is not limited thereto. Relationship for high m/z limit $(m/z)_{high}$ as a function of the rf-frequency (f) and radial dc-electric field component ($E_n$) can be estimated as follows:

$$m/z_{high}=eV_{RF}^2\exp(-2k_0/\delta)/2m_u\omega^2\delta^3E_n \quad (1)$$

Here, (e) is the elementary charge, (mu=$1.6605\times10^{-27}$ kg) is the atomic mass unit, ($\omega=2\pi f$) is the angular frequency, (h0≈0.5 mm) is the distance corresponding to the onset of ion losses on the surface of the ring electrodes, and ($\delta$) is related to the distance between the ring electrodes, d=1 mm, as ($\delta=d/\pi$). Assuming that the trapped ion ensemble is limited to $(m/z)_{high}$≈2000 amu, using (f)=600 kHz and the electric field characteristic for the dc trapping conditions, $(E_n)$=20 V/cm, from equation (1) the rf-voltage $(V_{RF})$≈30V, or 60 $V_{p-p}$, which is consistent with experimentally observed rf-amplitudes. In the continuous mode, both dc-trapping and space charge components of $(E_n)$ are reduced, which provides different $(V_{RF})$ values. Trapping efficiency strongly depends on the axial dc-gradient, e.g., as shown by the dependence of Reserpine monoisotopic peak intensity (FIG. 8) on the extraction time at four different dc-gradients in the trapping portion. Reduction of the dc gradient from 20 V/cm to 4 V/cm resulted in a more than 2 orders of magnitude improvement in sensitivity and an ion extraction time of 100 μs. Fast removal of ions from the IFT was important for efficient coupling of the ion trap to a subsequent ion stage, e.g., the oa-TOF mass spectrometer described herein. Ion current was measured at the collisional quadrupole and the charge collector (FIG. 5) in both the trapping and continuous modes. Estimate of trapping efficiency can be made based on comparison of ion signals at the collisional quadrupole in continuous and trapping modes.

Example 4

SIMION 8.0 Simulations

Profiles of Effective and DC Potentials in Dual Exit Grid Configuration for Ion Accumulation and Ion Ejection Ion accumulation and ejection from the IFT in both single- and dual-grid configurations were modeled using commercially available SIMION 8.0 software (Scientific Instrument Services, Ringoes, N.J.). Full potential distribution of the dual gate design was relatively uniform along the axis throughout the trapping portion of the IFT. A single gate configuration reduces overall trapping capacity of the IFT but also necessitates use of longer extraction times for full ion ejection. Specific spatial and electrical configurations of the two grids at the IFT exit enabled both effective ion accumulation and ejection. During an exemplary ejection event, potential of the trapping grid was ramped to ~50 V. Electric field gradient for the 5 mm ion trap segment immediately preceding the trapping grid was ~19 V/cm. A strong electric field at the IFT exit ensured fast ion ejection from the trap. The IFT was modeled using simulations performed with SIMION 8.0 (Scientific Instrument Services, Ringoes, N.J.) software that simulates motion of charged particles in rf-fields. Ion collisions with nitrogen buffer gas were modeled assuming ion-neutral hard-sphere collision using a code available with SIMION 8.0. A group of 50 particles with a total charge of $1.6\times10^{-13}$ C (distributed equally on the particles) were flown through 1 Torr of static nitrogen buffer gas. As charged particles travel within the trap, they experience an oscillating rf-field in addition to dc-gradient. Charged particles were stored in the IFT by applying a trapping voltage to entrance grid. After trapping for 2 ms, voltage on the entrance grid was lowered to release the ions. Simulations were performed for singly charged Reserpine (m/z=609) at an rf-frequency of 600 kHz and an rf-amplitude of 74 $V_{p\text{-}p}$ and for 20 V/cm and 4 V/cm dc-gradients in the IFT. Under 20 V/cm dc-gradient conditions, 36 particles were lost on electrodes before being released from the trap (72% loss). No particles were lost during trapping with a 4 V/cm dc-gradient. The effective potential (V*) was derived according to the following equation:

$$V*(r, z) = \frac{q^2 E_{RF}^2(r, z)}{4m\omega^2}$$

Here, q=ze is the ion charge; $E_{RF}(r, z)$ is the amplitude of the rf-electric field; m is the ion mass, and ω is the angular frequency of the rf-field. The dc-gradient was superimposed on (V*) to generate a full effective potential. Calculated full effective potentials were normalized to the potential at the trap entrance for direct comparison. Under 20 V/cm dc-gradient, ions are trapped in a well of ~8 V very close to the trap exit electrode leading to their instability and loss. Under trap dc-gradient of 4 V/cm, effective potential shows no distinct region where ions can be directed into. Accordingly, accumulated ions are closer to the trap axis rather than near the electrodes.

CONCLUSIONS

An ion trap has been described that operates at pressures which enable seamless interfacing to atmospheric pressure ionization sources. The trap operating pressure can also be increased for, e.g., more efficient coupling to mobility separations. For example, in an exemplary configuration, the IFT is characterized by an extraction time of 40 μs for multiply charged ions and 100 μs for singly charged species. Performance of the IFT coupled to a TOF-MS was examined in both trapping and continuous modes. In the continuous mode, TOF MS provides a high pulsing rate of ~10 kHz, and given sufficient ion current, each successive TOF pulse can deliver ions to the detector. In trapping mode, only 100-1000 ion packets are delivered to the TOF detector over the same acquisition period. However, packets of ions accumulated in the IFT are characterized by higher charge density than those in continuous mode. Improved S/N in the trapping mode results from a combination of factors that contribute to an increase in signal intensity and a decrease in the chemical background. Ion accumulation in the trap appears to be particularly advantageous at very low analyte concentrations. Ion packets exiting the IFT are characterized by higher ion densities and, therefore, result in higher S/N values. In addition, the IFT facilitates more efficient desolvation of ions resulting in substantial reduction in background noise and further S/N improvement. Incorporation of a dual-grid gating design in the IFT increases effective charge capacity, ejection efficiency, and ion packet charge density. A 7-fold increase in signal is observed based on comparisons of a pulsed ion current obtained from IFT-IMS experiments against a continuous ion current. The IFT allows injection of ion packets with ion densities that are 1 order of magnitude greater than conventional IMS gating mechanisms. Additional comparisons between trapped and continuous signal levels indicate that, for minimal ion accumulation times, ion utilization efficiency of the IFT approaches 100%. While these short accumulation times (<10 ms) are much less than a typical IMS scan time (~60 ms), such accumulation times are an ideal length for integration with other approaches, including multiplexing, to enhance instrumental duty cycle. By combining efficient ion accumulation of the IFT with techniques such as multiplexing, traditional limitations of the IMS duty cycle can be effectively circumvented and ion utilization efficiencies of >50% can be realized.

While exemplary embodiments of the present invention have been shown and described, it will be apparent to those skilled in the art that many changes and modifications may be made without departing from the invention in its true scope and broader aspects. The appended claims are therefore intended to cover all such changes and modifications as fall within the spirit and scope of the invention.

SEQUENCE LISTING

```
<160> NUMBER OF SEQ ID NOS: 2

<210> SEQ ID NO 1
<211> LENGTH: 9
<212> TYPE: PRT
<213> ORGANISM: Homo sapiens

<400> SEQUENCE: 1

Arg Pro Pro Gly Phe Ser Pro Phe Arg
1               5
```

-continued

```
<210> SEQ ID NO 2
<211> LENGTH: 16
<212> TYPE: PRT
<213> ORGANISM: Homo sapiens

<400> SEQUENCE: 2

Ala Asp Ser Gly Glu Gly Asp Phe Leu Ala Glu Gly Gly Gly Val Arg
1               5                   10                  15
```

We claim:

1. A system for ion analysis characterized by an ion trap, said ion trap comprising:

an inlet portion defined by electrodes that diverges ions in an ion beam introduced thereto to expand same;

a trapping portion defined by a plurality of electrodes having center openings of an equal dimension that define a chamber for trapping and accumulating a preselected quantity of said ions received from said inlet portion that is separate from and operatively coupled to said inlet portion, said trapping portion includes a first electrostatic grid that controls entry of said ions received from said inlet portion and at least one second electrostatic rid that controls outflow of preselected ions therefrom; and an outlet portion defined by electrodes that are operatively coupled to said trapping portion that converges said preselected ions released from said trapping portion.

2. The system of claim 1, wherein each of said electrodes of said ion trap has an inner geometry that is symmetric in the X plane, the Y plane, or the X/Y plane with respect to the Z-axis of said ion trap.

3. The system of claim 1, wherein each electrode of said ion trap includes an rf-potential that is phase shifted 180 degrees from a subsequent electrode in said ion trap.

4. The system of claim 1, wherein said electrodes of said inlet portion are a series of axially aligned concentric ring electrodes that define an ion flow path, each of said electrodes in said series has an inner geometry perimeter that is equal to, or greater than an electrode preceding it in said series.

5. The system of claim 4, wherein said series of electrodes includes a first electrode that couples said inlet portion to a conductance limit of a preceding ion stage.

6. The system of claim 5, wherein said preceding ion stage includes an electrodynamic ion funnel.

7. The system of claim 1, wherein said electrodes of said trapping portion are a series of axially aligned concentric ring electrodes, each of said electrodes in said series has an inner geometry perimeter that is equal to, smaller than, or greater than, an electrode preceding it in said series that provide for accumulation of said preselected quantity of said ions therein.

8. The system of claim 7, wherein said trapping portion includes one or more trap gradient controls.

9. The system of claim 8, wherein said one or more trap gradient controls couple to an electrode positioned adjacent to or following said first grid, and an electrode positioned adjacent to or prior to at least one of said at least one second grids, said trap gradient controls provide preselected DC-potentials superimposed over RF potentials at said electrodes.

10. The system of claim 1, wherein said at least one second grids includes two electrostatic grids, a trapping grid that traps ions in said trapping portion for a preselected time for accumulation of said ions; and an exit grid that releases said ions from said trapping portion at a preselected rate.

11. The system of claim 10, wherein said trapping grid and said exit grid are DC-grids.

12. The system of claim 10, wherein said trapping grid and said exit grid are comprised of a metal mesh defined by a preselected density of adjacent squares, said trapping grid and said exit grid are disposed a preselected separation distance apart from each other on an exit side of said trapping portion, said separation distance is on the order of spacing between said adjacent squares of said metal mesh.

13. The system of claim 1, wherein said electrodes of said outlet portion are a series of axially aligned concentric ring electrodes that define an ion flow path, each of said electrodes in said series has an inner geometry perimeter that is equal to, or smaller than, an electrode preceding it in said series that converges and focuses ions in introduced to said outlet portion.

14. The system of claim 13, wherein said outlet portion includes an ejection gradient control that couples to a DC electrode positioned adjacent to and following said at least one second grid in said trapping portion, said ejection gradient control provides a preselected potential to said DC electrode that moves said preselected ions received from said trapping portion into said outlet portion.

15. The system of claim 13, wherein said outlet portion includes a conductance limit electrode that couples said outlet portion to a subsequent on stage and provides said preselected ions at a preselected pressure to said subsequent on stage.

16. The system of claim 15, wherein said conductance limit has an inner geometry perimeter that is equal to, or smaller than, an inner geometry perimeter of said subsequent on stage.

17. The system of claim 1, wherein said electrodes of said outlet portion define a converging angle for said outlet portion of about 30 degrees.

18. The system of claim 1, wherein said on trap has a length in the range from about 0.5 mm to about 50 mm.

19. The system of claim 1, wherein said ion trap has an inner electrode geometry cross section selected in the range from about 0.02 mm to about 20 mm.

20. The system of claim 1, wherein said ion trap is used as an interface between an electrostatic ion funnel and an ion analysis instrument, or a component thereof.

21. The system of claim 20, wherein said ion trap delivers preselected dc-potentials and rf-potentials that are independent of those of said ion funnel.

22. The system of claim 20, wherein said ion trap provides a dc-gradient that is controlled independently from a dc-gradient of said ion funnel.

23. The system of claim 22, wherein said dc-gradient of said ion trap is between about 1 V/cm and about 5 V/cm, and said dc-gradient of said ion funnel is between about 10 V/cm and about 30 V/cm.

24. The system of claim 20, wherein said ion trap includes an rf-frequency of about 600 kHz, an amplitude of about 55 $V_{p-p}$, and a pressure of between about 1 Torr and about 5 Torr.

25. The system of claim 20, wherein said ion funnel includes a pressure selected in the range from about 0.1 Torr to about 100 Torr.

26. A method for transmission of ions between at least two operatively coupled instrument stages for analysis, comprising the steps of:

introducing ions in an ion beam from an ion source to an ion trap comprising:

an inlet portion that diverges said ions in said ion beam introduced thereto to expand same;

a trapping portion defined by a plurality of electrodes having center openings of an equal dimension that define a chamber for trapping and accumulating a preselected quantity of said ions received from said inlet portion that is separate from and operatively coupled to said inlet portion, said trapping portion includes a first electrostatic grid that controls entry of said ions received from aid inlet portion and at least one second electrostatic grid that controls outflow of preselected ions therefrom; and an outlet portion operatively coupled to said trapping portion that converges ions released from said trapping portion to focus same;

trapping a preselected quantity of said ions in said trapping portion for a preselected time to accumulate same; and selecting at least one of said ions mass accumulated in said trapping portion; and releasing said at least one of said ions at a preselected pressure for analysis of same.

27. The method of claim 26, wherein the step of introducing ions in an on beam from an on source to an on trap includes an on source that is an electrospray ionization source (ESI), or a matrix-assisted laser desorption ionization (MALDI) source.

28. The method of claim 26, wherein the step of introducing ions in an on beam from an on source to an on trap includes an on stage that precedes said on trap selected from the group consisting of on mobility spectrometry (IMS), field asymmetric waveform on mobility spectrometry (FAIMS), longitudinal electric field-driven FAIMS, on mobility spectrometry with alignment of dipole direction (IMS-ADD), higher-order differential on mobility spectrometry (HOD-IMS), or combinations thereof.

29. The method of claim 26, wherein the step of releasing said at least one of said ions at a preselected pressure for analysis of same includes an on stage following said ion trap selected from the group consisting of on mobility spectrometry (IMS) time-of-flight mass spectrometry (TOF-MS), quadrupole mass spectrometry (Q-MS), on trap mass spectrometry (ITMS), and combinations thereof.

30. The method of claim 26, wherein the step of trapping a preselected quantity of said ions in said trapping portion includes an electric field that is about 1 V/cm.

31. The method of claim 26, wherein the step of releasing said at least one of said ions at a preselected pressure for analysis includes an electric field gradient for transmission of said ions that is about 20 V/cm.

32. The method of claim 26, wherein the step of releasing said at least one of said ions includes a rate of on ejection from said on trap that is determined by dc-potentials applied to electrodes of said trapping portion and pulsed potentials applied to said entrance grid and said trapping grid, respectively.

* * * * *

UNITED STATES PATENT AND TRADEMARK OFFICE

CERTIFICATE OF CORRECTION

PATENT NO. : 7,888,635 B2
APPLICATION NO. : 12/156360
DATED : February 15, 2011
INVENTOR(S) : Mikhail E. Belov et al.

It is certified that error appears in the above-identified patent and that said Letters Patent is hereby corrected as shown below:

Title Page;

Page 1 (75) Inventors: Change “Biran H. Clowers” to “Brian H. Clowers”

Page 1 Assistant Examiner: Change “Nicole ippolito Rausch” to “Nicole Ippolito Rausch”

Col. 18, line 39: replace “on” with “ion”

Col. 18, line 40: replace “on” with “ion”

Col. 18, line 43: replace “on” with “ion”

Col. 18, line 49: replace “on” with “ion”

Col. 19, line 21: replace “aid” with “said”

Col. 19, line 34: replace “on” with “ion” (three instances)

Col. 20, line 1: replace “on” with “ion”

Col. 20, line 5: replace “on” with “ion” (three instances)

Col. 20, line 6: replace “on” with “ion” (two instances)

Col. 20, line 7: replace “on” with “ion”

Col. 20, line 8: replace “on” with “ion”

Col. 20, line 9: replace “on” with “ion”

Col. 20, line 11: replace “on” with “ion”

Col. 20, line 15: replace “on” with “ion”

Col. 20, line 16: replace “on” with “ion”

Col. 20, line 18: replace “on” with “ion”

Col. 20, line 28: replace “on” with “ion”

Col. 20, line 29: replace “on” with “ion”

Signed and Sealed this
Twenty-fourth Day of May, 2011

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,888,635 B2
APPLICATION NO. : 12/156360
DATED : February 15, 2011
INVENTOR(S) : Mikhail E. Belov et al.

It is certified that error appears in the above-identified patent and that said Letters Patent is hereby corrected as shown below:

Col. 1, lines 3 through 6 should read,

The invention was made with Government support under grant number RR018522 from the U.S. National Institutes of Health and contract DE-AC05-76RL01830 awarded by the US Department of Energy. The government has certain rights in the invention.

Signed and Sealed this
Twenty-eighth Day of August, 2012

David J. Kappos

David J. Kappos
*Director of the United States Patent and Trademark Office*